United States Patent [19]

Lutzker

[11] 4,410,102

[45] Oct. 18, 1983

[54] CAN SEALER

[76] Inventor: Robert S. Lutzker, 21 Lee Ave., East Williston, N.Y. 11596

[21] Appl. No.: 386,957

[22] Filed: Jun. 10, 1982

[51] Int. Cl.[3] ..... B65D 45/28

[52] U.S. Cl. ..... 220/323; 220/256; 220/295

[58] Field of Search ..... 220/256, 323, 295, 302, 220/304

[56] References Cited

U.S. PATENT DOCUMENTS 3,913,779 10/1975 Blazer et al. ..... 220/323

3,955,707 5/1976 Mariner ..... 220/323

*Primary Examiner*—George T. Hall

*Attorney, Agent, or Firm*—Kane, Dalsimer, Kane, Sullivan and Kurucz

[57] ABSTRACT

A can top sealer includes a locking cap and ratchet plate which includes ratchets adapted to be shifted into engagement with the can below the can lip upon turning of the cap in one direction relative to the plate. Upon reverse movement the ratchets are retracted to free the sealer from the can. A gasket is included for purposes of completing the hermetic seal while a retaining ring maintains the parts in an assembled condition.

17 Claims, 9 Drawing Figures

CAN SEALER

BACKGROUND OF THE INVENTION

This application relates to can top opening closures and more particularly to closures for convenience opening cans sometimes referred to as "pop-top" cans containing carbonated beverages or drinks.

Upon the opening of a pop-top can, whether by a can opener, retaining or removable tab or otherwise, a problem forever confronting the consumer, housewife or parent when the drink is only partially consumed, is preserving the vitality of the carbonated drink for later consumption. To date, many can resealers have been proposed, but none have attained any wide degree of success or commercial acceptance for a variety of reasons, mainly, the inability to have one closure that effectively seals all pop-top cans no matter how they may be opened or their opening formed. More often than not, the carbonation in the drink simply will escape through the opening in the can thereby leaving the drink "flat". As a result, the size of pop-top cans have been restricted and the consumer obliged to complete the drink perhaps against his wishes once the can has been opened.

SUMMARY OF THE INVENTION

It is therefore a principal object of this invention to provide a can resealer that may be applied to all sized cans, no matter how opened, to preserve partially consumed liquids, beverages or drinks whether carbonated or not.

Another object is to provide a can resealer which may be used repeatedly, that is simple and rugged in construction and which is economical to manufacture, simple in operation and easy to use.

The several aforenoted objects and advantages among others will become apparent from the following detailed description which is to be taken in conjunction with the accompanying drawings.

DETAILED DESCRIPTION

Figure 1:
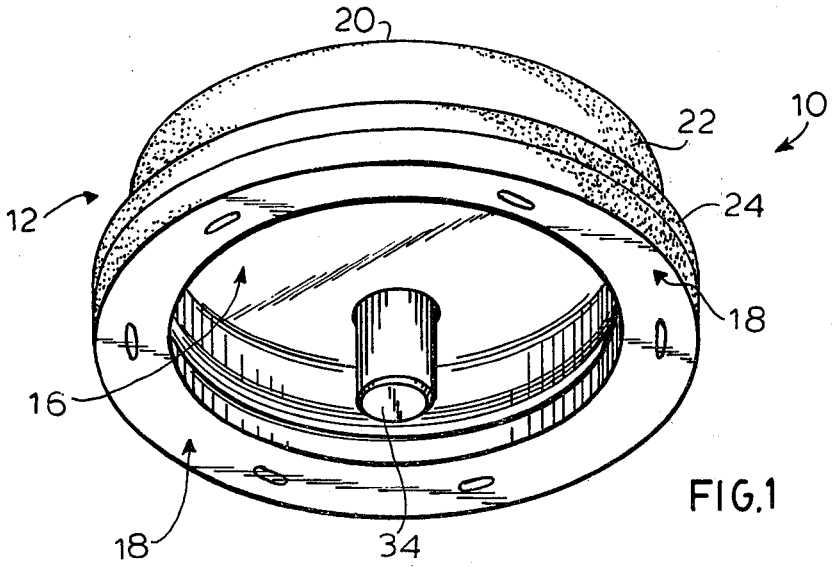
FIG. 1 is a bottom perspective view of a can resealer incorporating the teachings of this invention.
Figure 2:
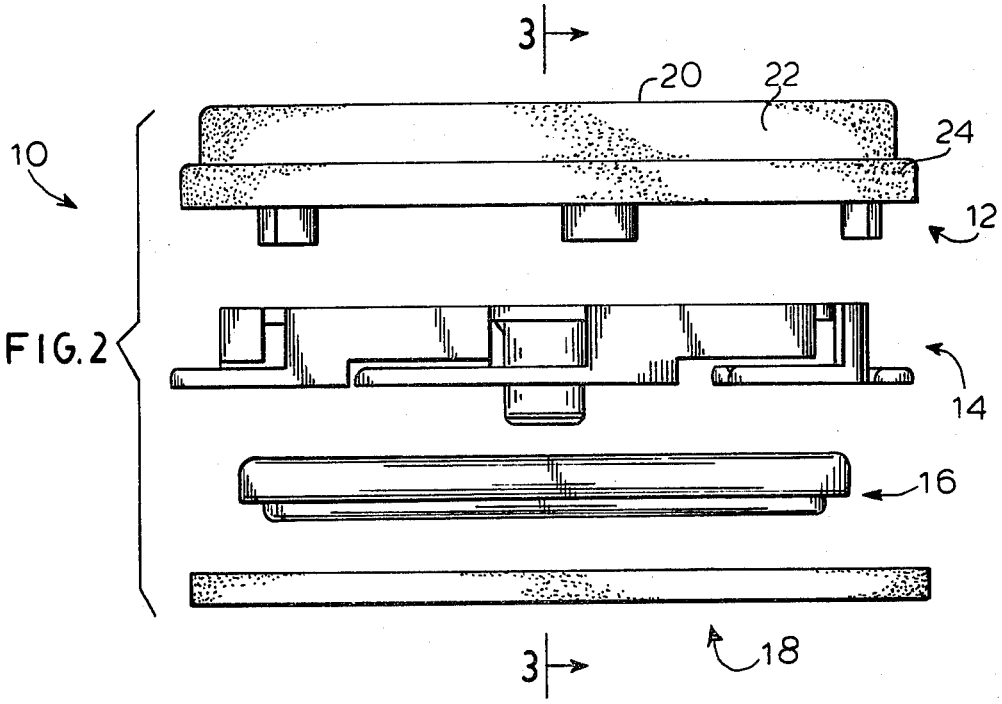
FIG. 2 is an exploded elevational view of the parts constituting the can resealer.
Figure 7:
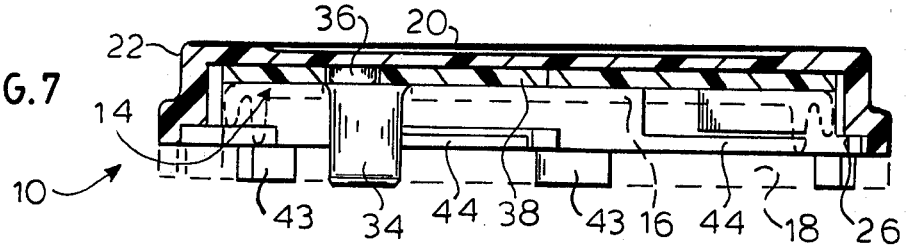
FIG. 7 is a sectional view taken along the line 7—7 of FIG. 6.
Figure 3:
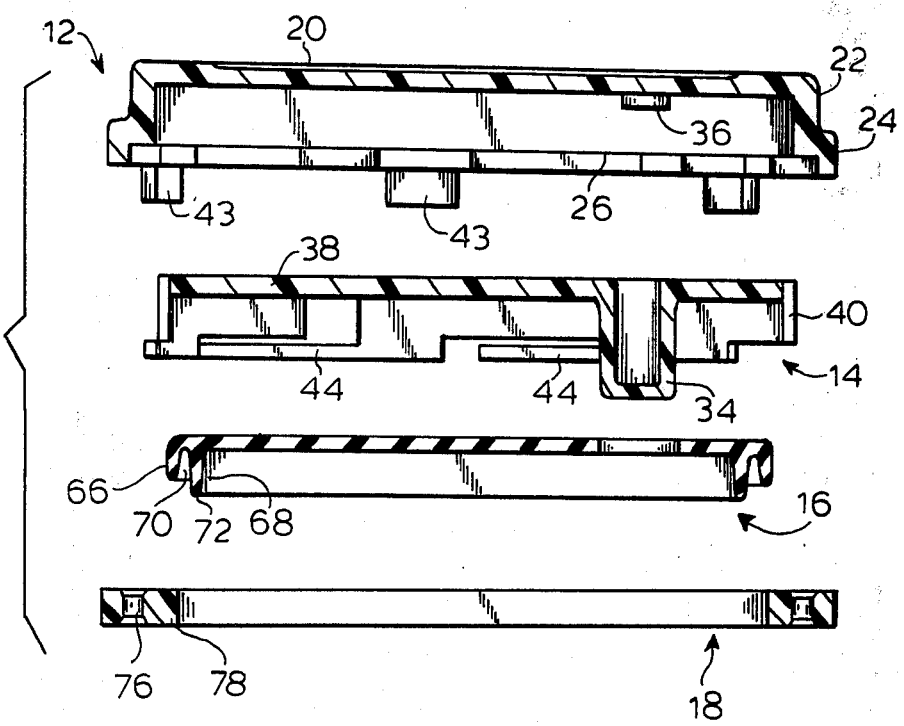
FIG. 3 is a sectional view taken along the line 3—3 of FIG. 2.
Figure 8:
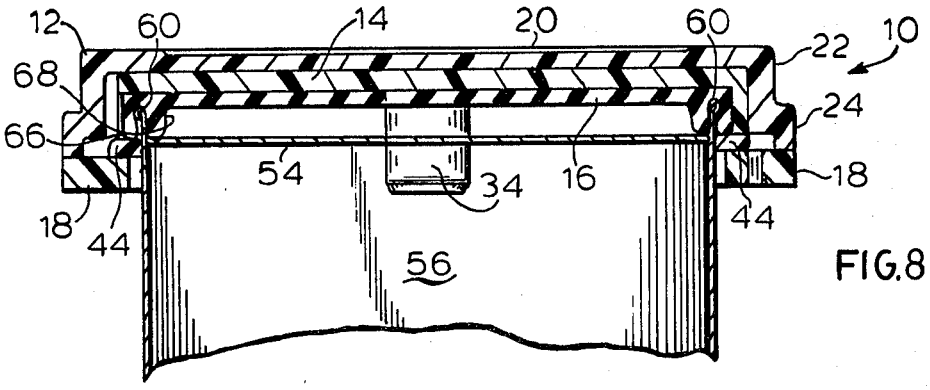
FIG. 8 is a sectional view taken along the line 8—8 of FIG. 6.

In the drawings, a can resealer 10 incorporating the teachings of the present invention includes a locking cap 12, ratchet plate 14, gasket 16 and retainer ring 18.

Referring to the locking cap 12, a substantially planar top 20 is provided with a peripherally extending circular skirt 22 which merges into an enlarged circular rim 24. Rim 24 is formed with spaced slotted recesses 26, each including an annular face 28 merging into a cam face 30 at one end and at the other end joining with a stop face 32. As will be apparent to those skilled in the art, the number of recesses 26 may vary in number depending upon the retention desired between the sealer 10 and the top of a can. Adjacent each stop face 32 is a downwardly depending lug 43 which cooperates in retaining the parts in an assembled condition. For purposes that will be described in detail shortly, the inner face of the top 20 includes a downwardly extending boss 36.

Referring now to the ratchet plate 14, a circular plate 38 is provided with a number of spaced laterally extending arcuate walls 40 adapted to be seated within the skirt 22 of the cap 12 for purposes of centering the ratchet plate within the cap during relative movement of these parts. In this connection, the plate 38 is provided with an arcuate slot 42 which receives the boss 36 extending from the inner face of the plate 20 of the cap 12. One or both ends of the slot 42 may serve as a stop, restricting movement of the boss 36 therein and consequently the relative movement of the ratchet plate 14 and cap 12. The plate 38 also includes a downwardly depending boss 34 adapted to be disposed within the opening of the can top to restrict movement of the sealer 10 relative to the can top to thereby enable turning movement of the cap 12 relative to the ratchet plate 14 in a manner to be described shortly.

Extending from one end of each of the walls 40 is a cantilevered ratchet 44, the outer edge 46 of which serves as a cam follower and the free end 48 and particularly the corner 50 serving as a retaining lug. In the normal and starting position, the ratchet 44 is adapted to be disposed and nested internally of the slot 26 in the cap 12 (see FIG. 4). When the sealer 10 is placed over an open carbonated beverage can, the boss 34 is disposed in the can top opening 52 appearing in the top 54 of the can 56. The locking cap is then turned clockwise relative to the can 56 and more specifically relative to the can top 54 as a result of the interengagement of the boss 34 with surface of the can top 54 that defines the opening 52. The outer edge 46 of the ratchet 44 will eventually cam against the cam face 30 as shown in FIG. 5 to thereby urge the ratchet 44 radially inwardly so that the corner 50 engages in the recess 58 below the can top lip 60. Upon further turning of the cap 12, the cam edge 46 rides passed cam face 30 and onto the circular surface 62 and eventually will settle thereon as a result of the stopping action caused by the engagement of the boss 36 against the end of the slot 42. (See FIG. 6). In view of the cantilever construction of the ratchet 44, the ratchet 44, although urged inwardly, will be flexed outwardly by its engagement with the surface of the recess 58 to the extent shown in FIG. 6 by phantom lines. In this position, the inner edge 64 or at least a major portion thereof will be disposed in the recess 58 and below the lip 60, thereby increasing the amount of bearing area of the contacting surfaces of the ratchet 44 and the lip 60 to increase the retaining pressures offered by the ratchet 44 and the lip 60 in retaining the seal 10 on the open top of the can 56. With the outer edge 46 engaging with the circular surface 62 there is little or no danger of the internal gas pressure within the container causing relative movement between the cap 12 and the ratchet plate 14. It has been discovered that six ratchets 44 provide sufficient bearing surface for retaining the seal 10 on an ordinary carbonated beverage can, but, obviously, as more bearing and retention pressure is required, the number of ratchets may be increased.

Figure 4:
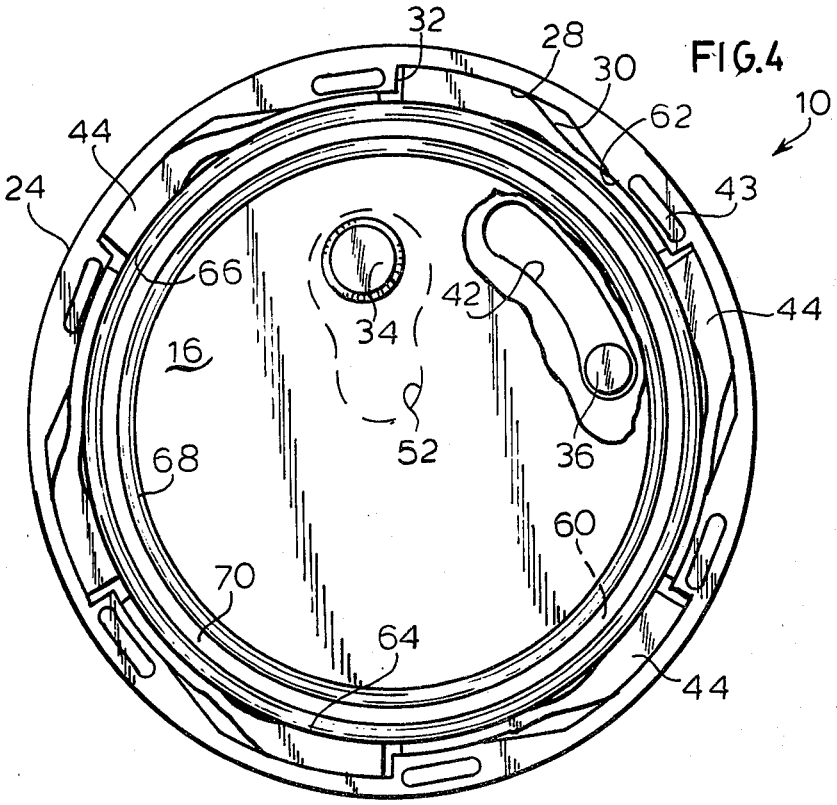
FIG. 4 is a bottom plan view of the can resealer in an unlocked position with certain parts broken away and removed and shown associated with an open can (in phantom) of carbonated beverage with the can resealer.
Figure 6:
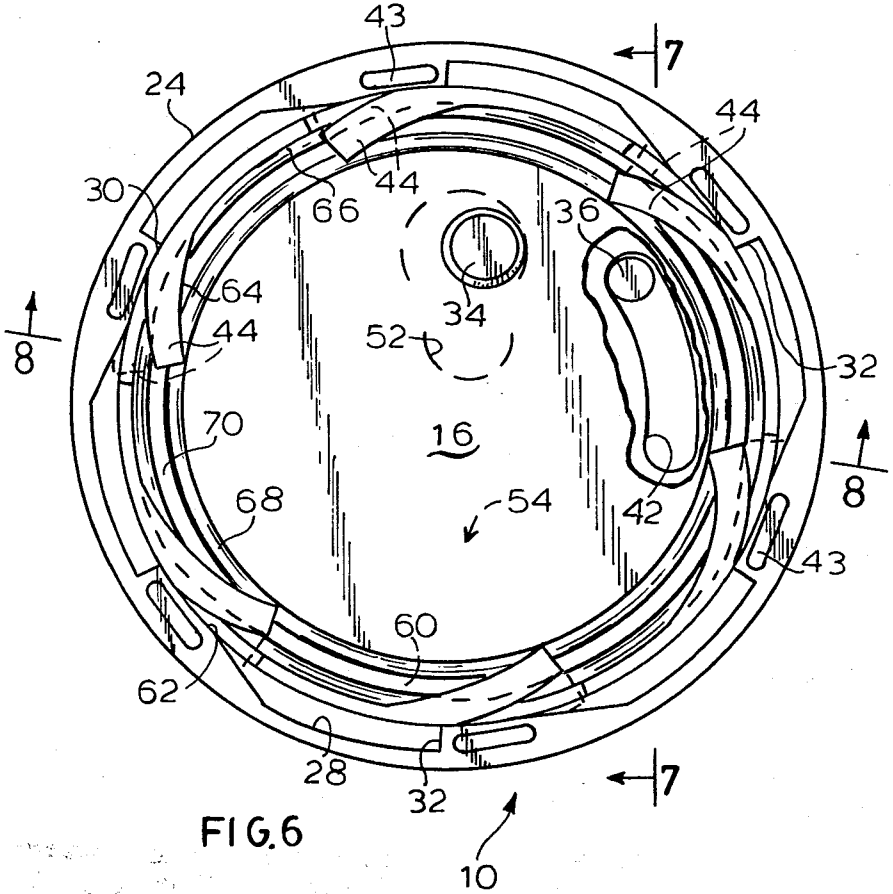
FIG. 6 is another plan view showing the can resealer in a completely locked position.
Figure 5:
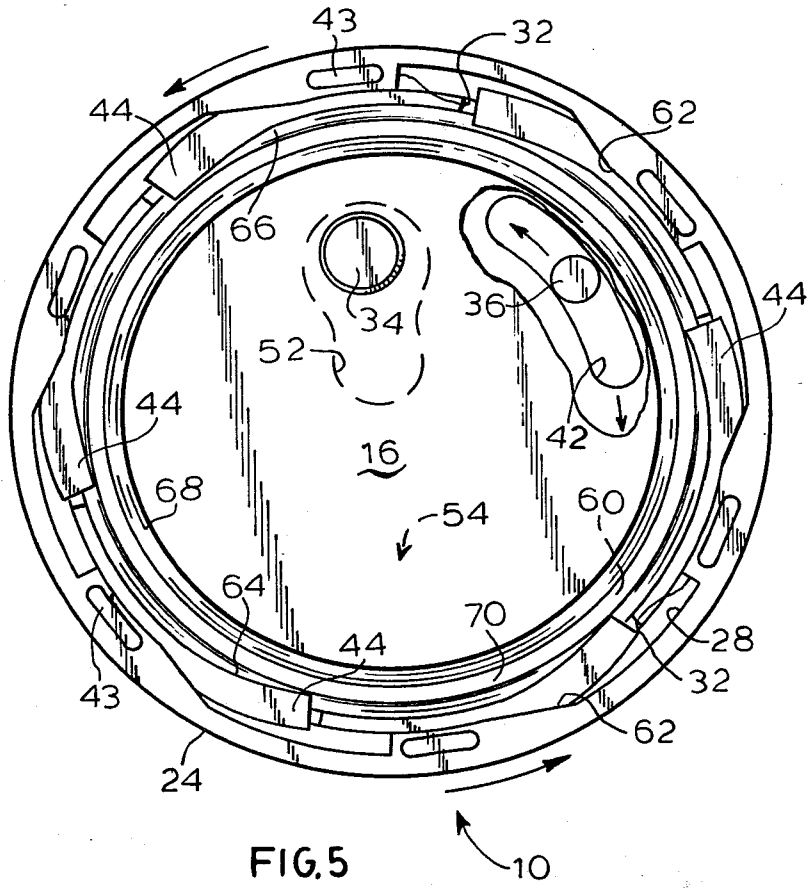
FIG. 5 is a similar plan view showing the can resealer actuated and disposed between a completely unlocked position and a locked position.

When it is desired to release the sealer 10 from the top of the can 56 to obtain access to the can interior, the consumer turns the cap 12 counterclockwise from the position of FIG. 6 to the position of FIG. 5 and ultimately to the position of FIG. 4. Thus, the ratchets 44 will be disposed within the recesses 26 to permit the consumer to simply lift off the sealer 10 from the top of the can 56. This procedure may be repeated as often as it is desired to reseal the opened can and obtain access to the contained beverage.

The gasket 16 may be deployed where necessary to assure the hermetic sealing relationship between the sealer 10 and the lip 60. Toward this end, gasket 16 will include a top 62 having an opening 64 that receives in a rather tight sealing fashion the boss 43. As explained, the gasket 16 is adapted to seat within the walls 40 of the ratchet plate 14. The gasket 16 is provided with an outer circumferentially extending apron 66 and an inner concentric apron 68. The annular space 70 between apron 66 and 68 is adapted to receive in a hermetically sealed fashion the lip 60 of the cam 56. In addition, the edge 72 of the apron 68 is adapted to rest against the exterior surfaces of the can top 54 to complete the seal between the gasket 16 and the cam 56.

The gasket is retained within the wall sections 40 of the ratchet plate 14 in any suitable manner, as, for example, the frictional engagement between the surfaces that define opening 64 and the boss 43. In addition, the inwardly extending projections afforded by the corner 50 of the ratchets 44 may be used for this purpose.

All of the parts are retained in assembled condition by the retainer ring 18. In this connection, the retainer ring 18 includes openings 76 that are adapted to align with the laterally projecting lugs 43 on the locking cap 12. The free ends of the lugs 43 will project slightly beyond the bottom face 78 of the ring 18 during the assembly procedure and then by spinning or heating or both, may be heat sealed or welded to the ring to remove the projections to retain the parts together.

For ease of handling and manipulating the sealer 10, surfaces of the cap 12 may be frosted or suitably roughened in any other fashion to facilitate the grip and increase the friction between the consumer's hands and the cap 12.

Thus, a beverage can sealer 10 is provided that releasably locks with any can having carbonated drinks or beverages. For this purpose, the sealer 10 is placed on the top 54 of can 56 with the locating boss 34 inserted into the can top opening 52. By simply pressing down on the top 20 of cap 12 where necessary and rotating it clockwise, the ratchets 44 will lock into place within the recess 58 below the lip 60. To remove the sealer 10, pressure is applied downwardly, if required, to the top 20 of the cap 12 and the cap is rotated counter-clockwise until it releases at which time the ratchets 44 will shift back into recesses 26 to clear the lip 60. The sealer 10 may be simply lifted off of the can top 54 to obtain access to the contents of the can.

In actual practice, it has been found that the sealer 10 of the present invention can withstand internal can pressures upwards of 70 pounds per square inch while maintaining an effective seal. For most effective seals, only 25 pounds per square inch retention pressure is necessary.

Another attractive and significant advantage of the present invention is that the sealer 10 is not limited to the configuration of the can top opening 52, and, as explained, the sealer 10 will work either with a so-called captive end, pop-top or convenience opening or a can with a solid end wall requiring the use of a can opener.

The several parts of the sealer 10 are advantageously molded from suitable resinous material with parts 12, 14 and 18 formed of high impact styrene, polyvinylchloride or the like. The seal 16 on the other hand, may be molded of low density polyethylene or polypropylene.

Figure 9:
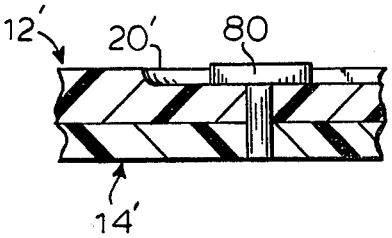
FIG. 9 is an enlarged fragmentary sectional view of another embodiment of can resealer utilizing a locking pin.

In the embodiment of FIG. 9, a locking pin 80 may be deployed to lock the sealer in a sealed position over an opened can top to releasably retain the cap 12' and ratchet plate 14' in the sealed position. Of course, these parts would have suitable holes as shown to receive the pin 80. When it is desired to remove the sealer, the pin 80 would be removed and the cap turned counter-clockwise as explained in the above. A sealer of this embodiment has particular application to cans that develop larger internal pressures or are subjected to abuse, as is the case of industrial drums up to 55 gallons in capacity.

Thus, the several aforenoted objects and advantages are most effectively attained. Although several somewhat preferred embodiments of the invention have been disclosed and described in detail herein it should be understood that this invention is in no sense limited thereby and its scope is to be determined by that of the appended claims.

I claim:

1. A can sealer for extending over the open top of a can containing any substance, as for example, a carbonated beverage, and for cooperating in retaining the carbonation of the beverage over extended periods of time, the can resealer comprising:

a locking cap having a skirt having at least one recess;

a ratchet plate having at least one cantilevered ratchet disposed in the recess of the cap when the resealer is in an unsealed position over the open top of the can, camming means defined by cooperating interengaging surfaces of the cap and ratchet for urging the ratchet out of the recess into engaged position with the can top to cooperate in retaining the sealer on the top of the can in a sealed position; and means for providing relative rotational movement between the cap and plate between the sealer in the sealed position and unsealed position.

2. The invention in accordance with claim 1, wherein the locking cap includes a top plate and the skirt extends downwardly and laterally therefrom.

3. The invention in accordance with claim 2, wherein a plurality of the recesses are formed in the skirt.

4. The invention in accordance with claim 3, wherein each recess is defined by an end wall, an arcuate side wall extending therefrom and a beveled cam face extending from the arcuate side wall, the cam face forming part of the camming means.

5. The invention in accordance with claim 4, wherein an arcuate face is interposed between the end wall of one recess and the camming face of the adjacent recess to define a step relative to the arcuate face on which the ratchet is adapted to rest when the sealer is in the sealed position at which the ratchet is retained in the engaged position with the can top.

6. The invention in accordance with claim 5, wherein, in the unsealed position of the sealer, the ratchet is disposed within the recess and the free end of the ratchet is adjacent the end face, upon rotation of the cap relative to the ratchet plate, the ratchet is adapted to cam against the camming face and be shifted radially inwardly into engagement with recess surfaces adjacent the lip of the can top, the ratchet being then adapted to ride onto the stepped face when the sealer is in the sealed position to retain the ratchet in said engagement, and when it is desired to shift the sealer into the unsealed position from the sealed position, the cap is rotated in the reverse direction to cause the ratchet to be withdrawn into the recess and free itself from the recess and lip of the can top to permit the sealer to be lifted off of the top of the can.

7. The invention in accordance with claim 6, wherein a plurality of ratchets are provided corresponding in number to the number of recesses in the locking cap.

8. The invention in accordance with claim 7, wherein the ratchet plate includes a top plate and a plurality of wall sections extending downwardly and laterally from the top plate, each ratchet being cantilevered from a wall section to permit each ratchet to flex radially inwardly from a position within the recess to its engaged position and then back from its engaged position into the recess.

9. The invention in accordance with claim 1, wherein means are interposed between the cap and the ratchet plate for limiting the extent of relative rotational movement between the cap and the ratchet plate.

10. The invention in accordance with claim 9, wherein the rotational limiting means is defined by a lug extending from the cap and a recess in the top plate of the ratchet plate.

11. The invention in accordance with claim 10, wherein the rotational limiting means is partly defined by the free end of the ratchet and the end face of the recess.

12. The invention in accordance with claim 1, wherein a boss extends laterally from the top plate of the ratchet plate to serve as a guide for placement of the sealer onto the can top such that the boss is disposed in the opening of the can top thereby also inhibiting rotational movement of the ratchet plate upon movement of the cap relative thereto.

13. The invention in accordance with claim 1, wherein a gasket is disposed interiorly of the ratchet plate to provide a hermetic gas tight seal between the sealer and the can top to retain the integrity of the substance within the can.

14. The invention in accordance with claim 13, wherein the gasket includes an opening through which the boss of the ratchet plate is adapted to extend and means for sealing the junction between the opening in and the gasket and the boss of the ratchet plate.

15. The invention in accordance with claim 13, wherein the gasket includes a pair of peripheral, spaced, concentric circular and circumferentially extending skirts defining a recess therebetween for receiving the lip of the can top.

16. The invention in accordance with claim 1, wherein a releasable locking means locks the cap and plate in sealing position on the can top.

17. The invention in accordance with claim 16, wherein the locking means is a pin extending through the cap and plate.

* * * * *